US006838629B2

(12) United States Patent
Baertl

(10) Patent No.: US 6,838,629 B2
(45) Date of Patent: Jan. 4, 2005

(54) ENERGY ACCUMULATOR FOR A SEQUENCE SWITCH

(75) Inventor: Reinhold Baertl, Regensburg (DE)

(73) Assignee: Maschinenfabrik Reinhausen GmbH, Regensburg (DE)

( * ) Notice: Subject to any disclaimer, the term of this patent is extended or adjusted under 35 U.S.C. 154(b) by 0 days.

(21) Appl. No.: 10/398,856

(22) PCT Filed: Sep. 20, 2001

(86) PCT No.: PCT/EP01/10866

§ 371 (c)(1),
(2), (4) Date: Apr. 8, 2003

(87) PCT Pub. No.: WO02/31847

PCT Pub. Date: Apr. 18, 2002

(65) Prior Publication Data

US 2004/0011631 A1 Jan. 22, 2004

(30) Foreign Application Priority Data

Oct. 13, 2000 (DE) ..... 100 50 932

(51) Int. Cl.[7] ..... H01H 3/40

(52) U.S. Cl. ..... 200/501; 200/11 TC; 200/400; 74/2

(58) Field of Search ..... 200/17 R, 18, 200/400, 401, 402–472, 501, 502–574, 318–327, 11 TC; 74/640, 436, 2

(56) References Cited

U.S. PATENT DOCUMENTS 5,107,200 A * 4/1992 Dohnal et al. ..... 323/340
5,786,552 A * 7/1998 Dohnal et al. ..... 200/11 TC

FOREIGN PATENT DOCUMENTS

| | | |
|---|---|---|
| CH | 483 713 | 2/1970 |
| DE | 1 956 369 | 5/1971 |
| DE | 28 06 282 | 8/1979 |
| DE | 199 13 814 | 4/2000 |
| DE | 100 50 932 | 6/2002 |
| WO | WO 89/08924 | 9/1989 |

* cited by examiner

*Primary Examiner*—James R. Scott
(74) *Attorney, Agent, or Firm*—Herbert Dubno; Andrew Wilford

(57) ABSTRACT

A force-storing unit for a tap changer has an output shaft journaled in a support and a pair of parallel guide rods fixed on the support, defining a longitudinal direction, and spaced parallel to the shaft. A force-storing slide and an output part are displaceable longitudinally along the rods between respective end positions. Teeth on the output part mesh with a gear carried on the output shaft. Mechanism between a drive shaft and the slide displaces the slide longitudinally on the rods in a direction dependent on a rotation direction of the drive shaft and loads a spring between the slide and the output part as the slide is moved longitudinally relative to the output part. A latch connected between the slide and the output part retains the output part in each of its end positions until the slide moves into the respective end position.

6 Claims, 3 Drawing Sheets

ENERGY ACCUMULATOR FOR A SEQUENCE SWITCH

CROSS-REFERENCE TO RELATED APPLICATIONS

This application is the US national phase of PCT application PCT/EP02/10866 filed 20 Sep. 2001 with a claim to the priority of German application 100 50 932.0 filed 13 Oct. 2000.

FIELD OF THE INVENTION

The invention relates to a force-storing unit for a tap changer wherein a longitudinally movable force-storing slide connected with an output shaft and an also longitudinally movable output part connected with the output shaft are provided, wherein the force-storing slide and output part are slidable on at least two parallel guide rods defining a longitudinal movement direction, wherein between the force-storing slide and the output part there is at least one tension spring, wherein on each actuation of the tap changer the force-storing slide is moved linearly by the rotating drive shaft in one of two directions and tensions the tension spring, and wherein once a new end position is reached by the force-storing slide the hitherto blocked output part is released so that it suddenly moves linearly following the force-storing slide.

BACKGROUND OF THE INVENTION

Such a force-storing unit is already known from German patents 1,956,369 and 2,806,282. This type of force-storing unit serves for the snap actuation of a load switch of a tap changer; it is loaded, effectively wound up, at the start of each actuation of the tap changer by its drive shaft. It is formed mainly as a force-storing slide and an output part that is often called the snap slide, between which there are one or more springs serving to store force.

The force-storing slide is thus moved linearly by an eccentric on the drive shaft relative to the output part so that the force-storing springs between them are tensioned. Once the force-storing slide reaches its new end position, the output part is unblocked and is thereby released. It is moved very suddenly to follow the linear movement of the force-storing slide since the force-storing springs were previously loaded. This snap-action linear movement of the output part is converted by a slider and a crank into rotation of a drive shaft. The fast-moving output shaft in turn serves for actuating the load switch of the tap changer, that is to switch between the previous and newly selected winding under load.

This known force-storing unit has however several disadvantages. The conversion of the linear movement of the output shaft via a slider and a tie rod and crank into a rotation of the output part results in a nonuniform force transmission or movement conversion. In addition as a result of this type of movement conversion and the practicable lever relationships of the crank, the resulting rotation angle of the output shaft for each switching is fairly limited. In practical embodiments of the known force-storing unit this angular movement is about 75 degrees. Such an angular movement is further limited by the maximum possible switching time which is available for the actuation of a load switch, that is for the uninterrupted changeover. For many load switches, in particular with switches that operate a plurality of contacts with each actuation, e.g. both mechanical contacts and vacuum switches, one after the other in a particular sequence, the known force-storing unit does not have enough angular movement to effect the desired movement. Finally the known force-storing units are fairly bulky since the force-storing slide, force-storing springs, and output part are provided one above the other in different horizontal planes.

German 199 13 814 describes how an output part of a force-storing unit of this type has on both of its longitudinal side an inwardly directed row of teeth in which, dependent on the movement direction of the output part, can engage selectively a gear carried on the output shaft. This known arrangement serves also, independently of the direction the force-storing unit is tensioned, to urge the output shaft always in the same direction so that a special additional device is needed to switch the gear wheel between opposite sides of the longitudinal rows of teeth. This makes the force-storing unit also quite complicated and takes up even more space than was necessary in the prior art.

OBJECT OF THE INVENTION

It is an object of the present invention to provide such a force-storing unit that produces a uniform movement, a larger movement angle of the output shaft, and as a result substantially longer switching times during load switching, and that also is compact and mechanically simple.

SUMMARY OF THE INVENTION

This object is achieved according to the invention by a force-storing unit wherein the two parallel guide rods are arranged one next to the other in a vertical plane, the output part partially surrounds the force-storing slide, the output part has a longitudinally extending row of teeth, and a gear carried on the output shaft meshes with the teeth.

BRIEF DESCRIPTION OF THE DRAWING

The invention is more closely described in the following with reference to the drawing. Therein.

SPECIFIC DESCRIPTION

Figure 1:
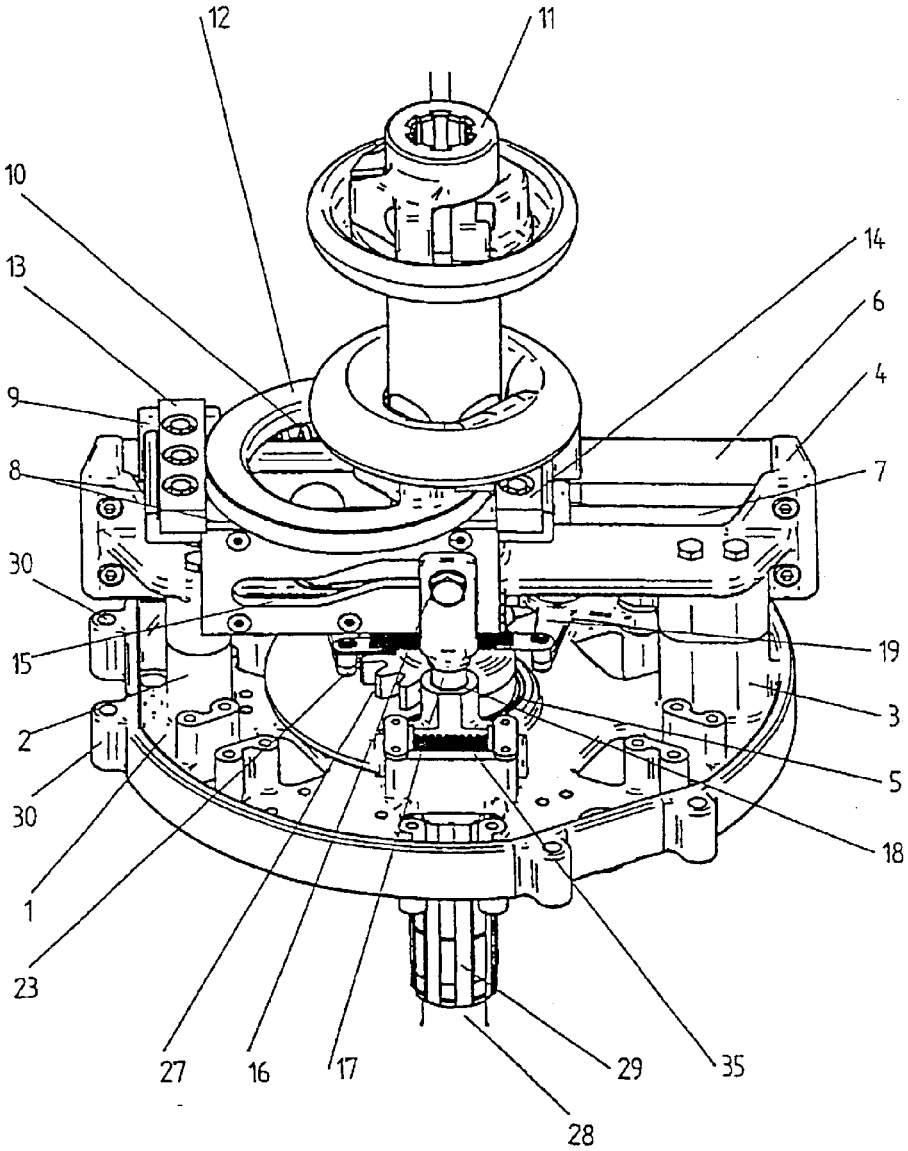
FIG. 1 is a complete force-storing unit according to the invention seen in perspective at an angle from above.
Figure 2:
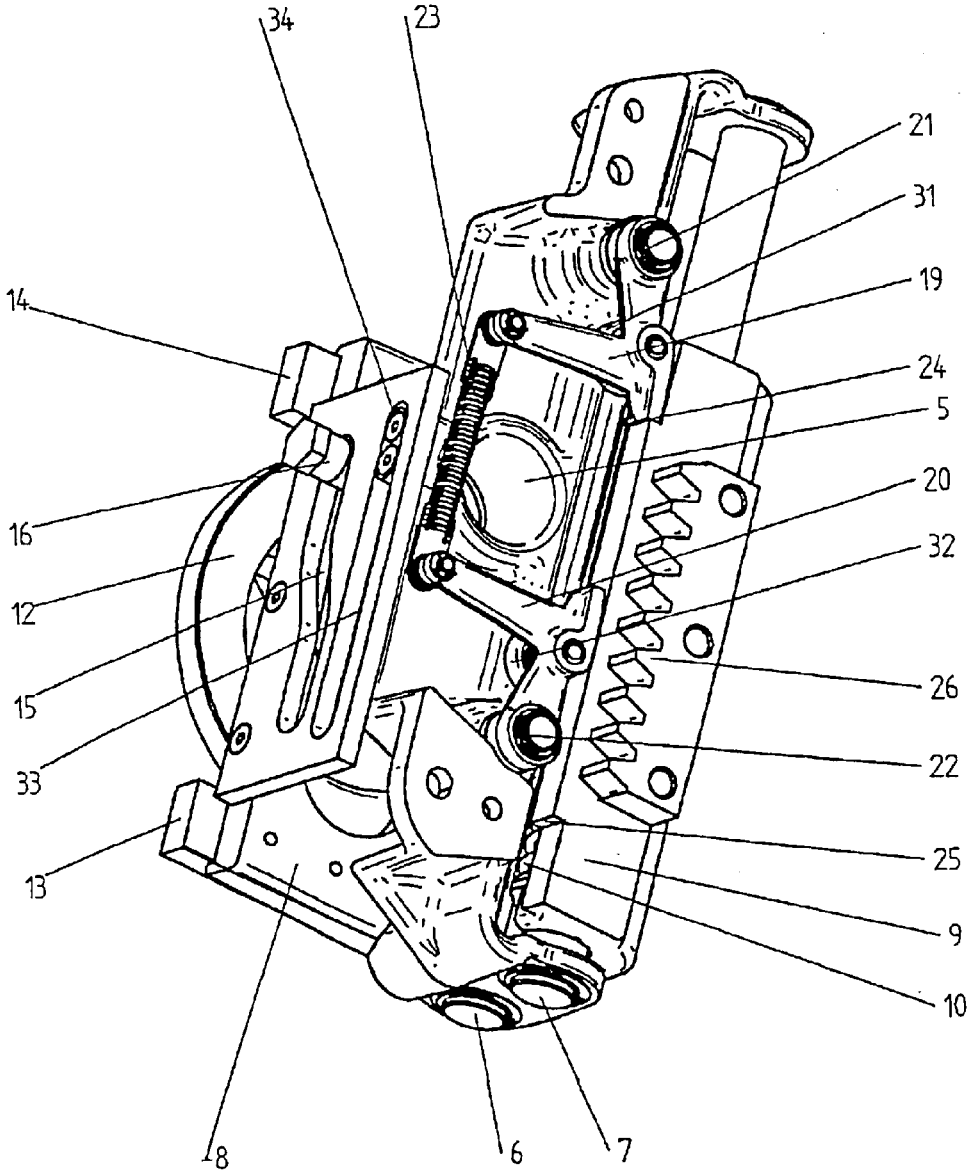
FIG. 2 is a subassembly of the force-storing unit seen in perspective at an angle from below, some parts being left out for clarity of view.
Figure 3:
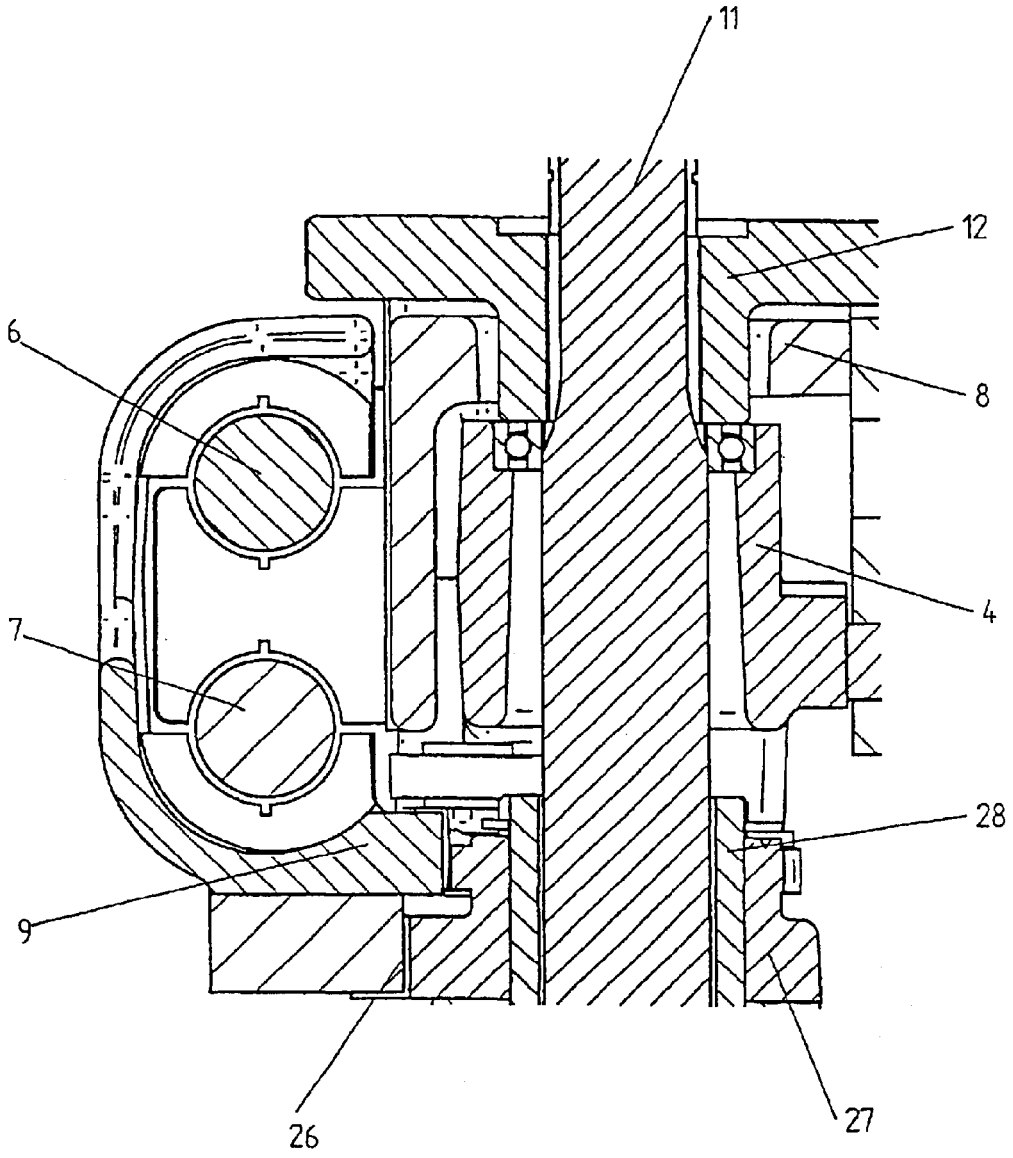
FIG. 3 is a schematic sectional detail.

To start with the mechanical features of the force-storing unit according to the invention will be described. A support plate 1 has mounting formations 2 and 3 to which is attached a stator 4 made of insulating material. The support plate 1 and the stator 4 fixed to it are the central support elements for all the parts of the force-storing unit according to the invention described below. The support plate 1 has a central passage 5 described more closely below. On the side of the stator 4, spaced one above the other, are two guide rods 6 and 7. Between them is the force-storing slide 8 that is movable in a straight line on the guide rods 6 and 7. In the region around the guide rods 6 and 7 there is also an output part 9 that is also movable in a straight line on the guide rods 6 and 7. The force-storing slide 8 and output part 9 are nested in each other as can be seen on the left side of FIG. 2 and in particular in FIG. 3. Between the force-storing slide 8 and the output part 9 are two force-storing springs 10 that are each carried on a respective one of the rods 6 and 7. A drive shaft 11 extends downward from above into the region of the force-storing unit and has on its free end an eccentric 12. This eccentric 12 coacts with two follower blocks 13 and 14 that are fixed on the force-storing slide 8. Rotation of the drive shaft 11 brings, according to the rotation direction, the eccentric 12 into engagement with one of the follower blocks 13 or 14 and shifts the force-storing slide 8 linearly to the right or left on the guide rods 6 and 7. On the side of the force-storing slide 8 is a formation 15 in which a roller 16 is. guided that is connected with a lift rod 17. This lift rod 17 extends downward through another hole 18 in the support plate 1 into the region of the load switch and there serves for moving cams or for moving the switch device of the load switch into various horizontal planes. Such a lifting mechanism is already described in published WO 89/08924. As it is not part of the invention, it is not described in detail here. The lower side of the stator 4 carries two pawls 19 and 20 mounted in respective bearings 21 and 22 and interconnected by a spring 23. The free ends of the pawls can engage in seats 24 and 25 on the output part 9. Rollers 31 and 32 that ride as is known on an unillustrated cam of the force-storing slide 8 operate these pawls 19 and 20.

In addition the output part 9 has on its lower side teeth 26 in the form of a straight gear segment or rack. A gear 27 in continuous mesh with these teeth 26 is fixed on the output shaft 28 extending through the central passage 5. The output shaft 28 with vertical splines 29 projects downward from the force-storing unit and is connected with the described but not illustrated cams or other vertically shiftable lifting devices.

Finally, underneath the formation 15 is a further guide formation 33 that extends parallel to the movement direction of the force-storing slide 8 and which accommodates guide rollers 34. This additional guide is, however, not strictly needed.

The force-storing unit according to the invention functions as follows: At the start of each switching operation the drive shaft 11 turns with its eccentric 12 that presses on one of the two followers 13 and 14 and, according to rotational sense, shifts the force-storing slide 8 to the right or the left on the guide rods 6 and 7. This shifting of the force-storing slide 8 relative to the output part 9 tensions the force-storing spring 10 spanned between them. Once the force-storing slide 8 reaches its new end position, one of the two pawl rollers 31 or 32, depending on movement direction, rides up on the unillustrated release formation. As a result, this pawl 19 or 20 is lifted out of the respective seat 24 or 25 of the output part 9 where it was previously engaged. The hitherto blocked output part 9 now suddenly moves in the same direction as the force-storing slide 8. The output part 9 is always also guided on the guide rods 6 and 7; the sudden movement destresses the force-storing springs 10. Once the output part 9 reaches its new end position, one of the two pawls 19 or 20 drops back into the respective seat 24 or 25 and blocks the output part 9 again. The described snap-action linear movement of the output part 9 is transmitted by the engaged teeth 26 and the gear 27 to the output shaft 28 and turns this output shaft 29. According to the dimensions—number, size, and type—of the teeth 26 and for example the diameter of the gear 27 determine the resulting angular movement of the output shaft 28 in a simple manner. Finally, support lugs 30 are provided on the support plate 1 by means of which this support plate 1 can be mounted for instance on the oil reservoir of the tap changer in any of several ways.

It is also possible to provide on the support plate 1 a damper 35 that coacts with one or more unillustrated abutments that are provided on the output shaft 28 or gear 27. In this manner the snap movement of the output shaft 28 is damped in a simple manner shortly before it reaches the new end position.

A particular advantage of the force-storing unit according to the invention is first the simple and uniform transmission of movement to the output shaft as described above. A further advantage is the also described simple establishment of the necessary rotation angle of the output shaft 28 with respect to the various requirements of the load switch being used, which once again are determined by the number, type, and sequence of the switches to be actuated. Finally the force-storing unit according to the invention is particularly compact. This is achieved in that the force-storing slide 8 and the output shaft 9 are engaged one within another around the guide rods 6 and 7 and the output part 9 partly extends around the force-storing slide 8.

What is claimed is:

1. A force-storing unit for a tap changer, the force-storing unit comprising:

a support;

an output shaft journaled in the support and rotatable about an axis;

a pair of parallel guide rods fixed on the support, defining a longitudinal direction, and spaced parallel to the axis;

a force-storing slide displaceable longitudinally along the rods between end positions;

an output part slidable longitudinally along the rods between respective end positions and nested with the force-storing slide;

a longitudinally extending row of teeth on the output part;

a gear carried on the output shaft and meshing with the teeth, whereby longitudinal displacement of the output part rotates the output shaft;

at least one tension spring engaged between the force-storing slide and the output part;

a rotatable drive shaft;

means including a mechanism between the drive shaft and the force-storing slide for displacing the force-storing slide longitudinally on the rods in a direction dependent on a rotation direction of the drive shaft and for loading the spring as the force-storing slide is moved longitudinally relative to the output part; and latch means connected between the force-storing slide and the output part for retaining the output part in each of its end positions until the force-storing slide moves into the respective end position, whereby the loaded force-storing spring displaces the output part out of its end position on movement of the force-storing slide into its end position.

2. The force-storing unit defined in claim 1 wherein the guide rods lie in a vertical plane parallel to the axis.

3. The force-storing unit defined in claim 1 wherein output part has a rack formed with the teeth.

4. The force-storing unit defined in claim 1 wherein the support is a horizontal plate.

5. The force-storing unit defined in claim 1 wherein the support includes a stator carrying the guide rods.

6. The force-storing unit defined in claim 1, further comprising a damper on the support plate and coupled with the output shaft.

* * * * *